United States Patent [19]

Dietrich

[11] 4,419,852

[45] Dec. 13, 1983

[54] DEVICE FOR PRESERVING CONNECTING BARS FOR CONCRETE STRUCTURAL MEMBERS

[75] Inventor: Hans Dietrich, Bolligen, Switzerland

[73] Assignee: Losinger AG, Berne, Switzerland

[21] Appl. No.: 269,048

[22] PCT Filed: Oct. 2, 1980

[86] PCT No.: PCT/CH80/00121

§ 371 Date: May 28, 1981

§ 102(e) Date: May 28, 1981

[87] PCT Pub. No.: WO81/01025

PCT Pub. Date: Apr. 16, 1981

[30] Foreign Application Priority Data

Oct. 3, 1979 [EP] European Pat. Off. ..... 79810113.5

[51] Int. Cl.[3] ..... E04C 1/00

[52] U.S. Cl. ..... 52/309.16; 52/378; 52/699

[58] Field of Search ..... 52/378, 712, 713, 637, 52/376, 699, 701, 98, 100, 334, 309.16, 368

[56] References Cited

U.S. PATENT DOCUMENTS

| | | | |
|---|---|---|---|
| 1,715,743 | 6/1929 | Duggan | 52/712 |
| 1,742,883 | 1/1930 | Venzie | 52/378 |
| 1,798,134 | 3/1931 | Danielson | 52/713 |
| 4,010,586 | 3/1977 | Brechbuhler | 52/378 |

FOREIGN PATENT DOCUMENTS

| | | | |
|---|---|---|---|
| 884553 | 12/1961 | United Kingdom | 52/378 |

*Primary Examiner*—Reinaldo P. Machado

*Attorney, Agent, or Firm*—Oldham, Oldham, Hudak, Weber & Sand Co.

[57] ABSTRACT

A preserving element (5) formed as a synthetic material mould part has preserving troughs (6) in which the bent end sections (3*b*) of connecting bars (3), later to be bent out, are embedded with a brittle mass (7). The device has the advantage that after the anchoring of the connecting bars (at 3*a*) in the structural member (2), the element (5) and the mass (7) can be easily removed. The device forms an easily transported and handled structural unit which is usable in the production of construction joints of steel concrete structures of any kind.

7 Claims, 4 Drawing Figures

DEVICE FOR PRESERVING CONNECTING BARS FOR CONCRETE STRUCTURAL MEMBERS

Figure 1:
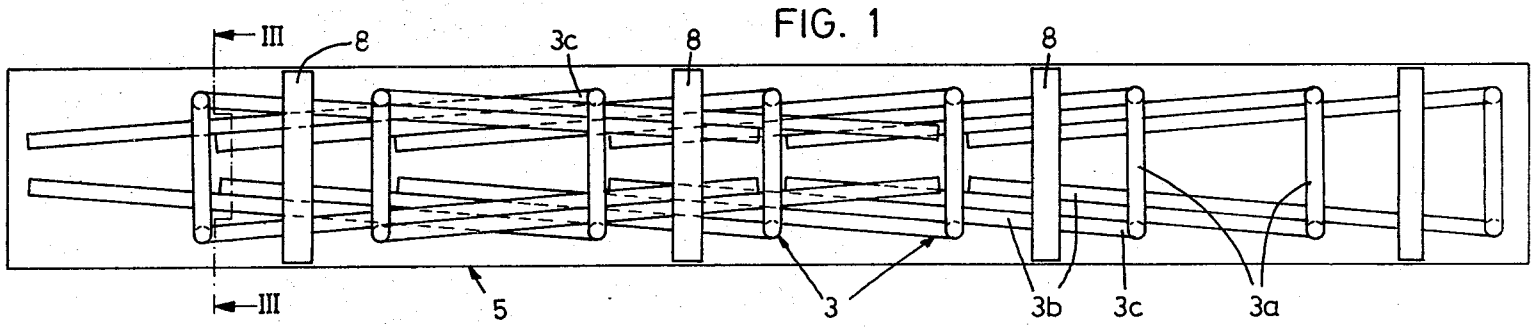

The invention relates to a device for preserving connecting bars which is fastened into the shuttering during the production of steel concrete structures and which exhibits an elongated preserving element in which the end sections of the connecting bars, to be bent out for connecting a concrete structural member to be connected later, but first bent approximately at right angles, are inserted.

In the production of concrete structures a distinction is made between space joints (also called expansion joints) and construction joints. Whereas the former form a permanent delimitation of one structural member relative to another, the latter are necessary only for technical reasons of execution; they are supposed to guarantee later on a force-locking connection largely corresponding to the monolithically cast members.

It is customary to make connecting bars a party to such a connection. In order not to have to provide for holes in the shuttering of the construction joint, through which holes such connecting bars extend, the portions of the connecting bars projecting from the structural member to be first concreted are first bent approximately at right angles and are fastened to the shuttering or near the shuttering in such a way that they can be be bent out or back again after removal of the shuttering. In order at the same time to keep the bent portions of the connecting bars free of concrete and to facilitate the mentioned bending out and back, a device for preserving connecting rods is sometimes used, which device is inserted in the shuttering and fastened and guarantees during concreting the formation of a cavity around the end sections of the connecting bars to be bent out.

Such preserving devices are already known in various designs, among others from DE Patent Specification No. 2,307,073 and from CH Patent Specification No. 562,376. The former of these prior publications discloses a preserving device which consists of preserving pieces, preserving front, and spacing strips lying between and is made of an elastically deformable material. The fabrication of this device is very expensive, but has the advantage of easy stripping off the first-concreted structural member. According to the second of the above-mentioned two publications the preserving element consists of a foam material body in which the end sections of the connecting bars to be bent out are embedded. This solution has found wide application; however, the scraping-out of the foam material necessary after stripping of the first-concreted structural member is time-consuming and involves the risk that residues, which disturb the force-locking connection of the following concrete member, remain stuck in the construction joint.

The task underlying the invention is to indicate for a preserving device of the above-described kind a formation which retains the advantages of the previously known embodiments without their disadvantages being inherent therein. Production should not only be economical, but also the removal of the device, no longer needed after stripping of the first-concreted structural member, should be able to take place quickly and effortlessly.

The task is solved in that the preserving element consists mainly of a thin-walled mould part formed of thermoplastic synthetic material (produced by the press-mould or deep-drawing method), in which preserving troughs open towards the flat side, receiving the end sections, are otherwise filled with an embedding mass, brittle in the hardened state, adhering neither to the connecting bars nor to the synthetic material mould part, the device as a whole forming a rigid structural unit of permanent shape.

As the embedding mass, silicate-base mixtures are used to advantage, as for example plaster-sawdust mixture or aeroconcrete, the desired properties of which are widely controllable through additives, as for example bentonite. The adhesion of the embedding mass to the concrete of the structural member can also be easily avoided by a coat of parting compound, as for example white lime. For laying bare the connecting bars, it suffices to rip off the preserving element formed of thermoplastic synthetic material after removal of the shuttering and, with a few hammer blows, to rid the end sections of the connecting bars of the brittle embedding mass.

In order to prevent the connecting bars and the embedding mass from falling out of the preserving element, it is advisable to provide for preserving troughs having a dovetail cross-section, or to fasten flat safety strips detachably to the preserving element across the preserving troughs.

In a preferred embodiment it is provided for that on the flat side of the preserving element, elevations are formed which butt against the convex side of the bending sections of the connecting bars projecting from the preserving troughs. It is thereby managed to keep the device as thin and thus also as light as possible, but at the same time also to achieve that no concrete lies upon the convex side of the bending sections, which concrete would hinder their bending back.

In addition, provision may be made to provide the side of the safety strips facing away from the embedding mass and/or the free surface of the embedding mass with a coating consisting of a cement setting retarder. By spraying away the non-set surface layer portions with water, there then ensue on the first-concreted structural member rough surfaces which promote a good bond in the construction joint being formed later.

The invention is explained below by way of example with the aid of the enclosed drawing.

Figure 4:
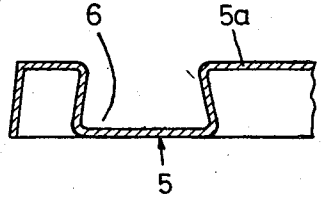
Figure 3:
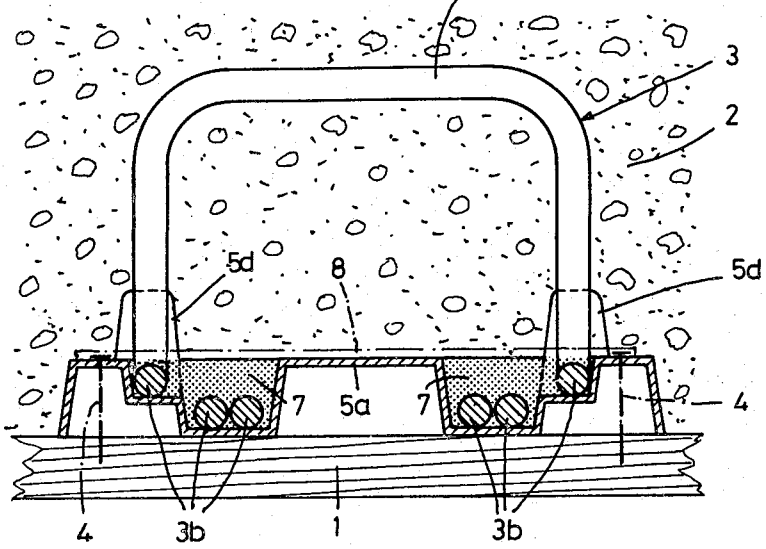
Figure 2:
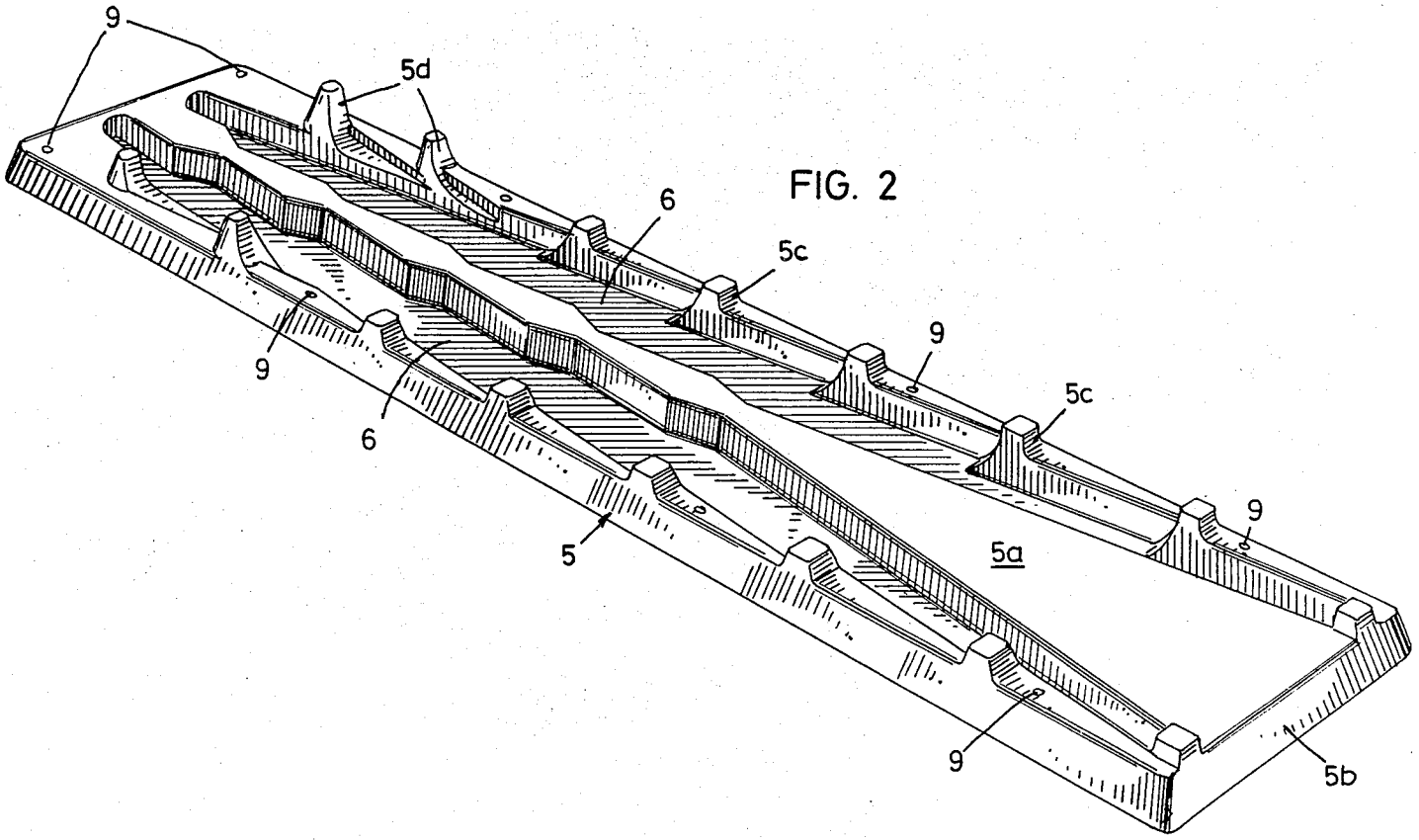

FIG. 1 shows a schematic top plan view of an embodiment of the device according to the invention, in which the end sections and, for the most part, also the bending sections of eight connecting bars are preserved, FIG. 2 shows a perspective view of the preserving element belonging to this device, FIG. 3 shows a cross-section along the line III—III of FIG. 1, and FIG. 4 shows a partial cross-section of a variant of execution of the preserving element.

The device described here is inserted in shuttering 1, which is intended for a concrete structural member 2, and serves for preserving end sections **3*b* of the connecting bars 3 anchored by their U-shaped portions 3*a* in this concrete structural member 2. It has an elongated, flat-bar-shaped preserving element 5 to be fastened, e.g., by nails 4, to the shuttering 1, in which element the mentioned end sections 3*b* of the connecting bars 3, to be bent out for connecting a concrete structural member to be connected later, rectilineal in this embodiment, are inserted according to the representation in FIGS. 1 and 3**, namely by pairs in two rows in such a way that they overlap in each row, for which purpose the inserted end sections 3*b* of each pair are arranged at an acute angle to one another.

As is to be seen from FIG. 1, the end sections of six of the eight connecting bars are directed towards the left, those of the two connecting bars which are depicted at the left-hand end of this FIG. 1 are directed towards the right, overlying some of the end sections directed towards the left. This arrangement results in a full utilization of the length of the preserving element 5. All the end sections 3*b* are connected by bending sections 3*c* at approximately right angles to the anchoring sections 3*a* intended to be anchored in the concrete structural member 2.

The above-described arrangement of the end sections 3*b* largely determines the shape of two preserving troughs 6 which are formed in the preserving element 5.

This last consists mainly of a thin-walled mould part formed of thermoplastic synthetic material, as for example polystyrene, e.g. by the press-mould or deep-drawing method, in which the preserving troughs 6 are open towards the flat side 5*a*, from which the anchoring portions 3*a* project. These troughs 6 receiving the end sections 3*b* are otherwise filled with an embedding mass 7 which was doughy upon being put in but is brittle in the hardened state and adheres neither to the connecting bars nor to the synthetic material mould part, so that afterwards—as described below—it can easily be removed. Suitable as the embedding mass are, for example, silicate-base mixtures, such as plaster-sawdust or aeroconcrete; as already mentioned, bentonite or another additive may be admixed. In its finished state the device forms a rigid structural unit of permanent shape which can be easily transported, handled, and fastened to shuttering 1. The element 5 is provided with passage-holes 9 for nails in its longitudinal edge regions.

On the preserving element 5 there is a jacket wall 5*b* running all around it, which the cover wall forming the flat side 5*a* adjoins. Formed in the latter wall are elevations 5*c*, 5*d*, one wall portion of which—as is apparent from FIG. 2—lies in the continuation of a curved trough-wall portion and, together with the latter, butts against the convex side of the bending sections 3*c* of the connecting bars 3 projecting from the preserving troughs 6. It is thereby achieved that cavities are formed behind the bending sections 3*c* in the concrete of the structural member 2 and thus the later bending-back of these sections is practically not hindered.

According to the representation in FIG. 3, the preserving troughs 6 have a cross-section broadening slightly from the bottom to the flat side 5*a*, which facilitates the forming-out of the preserving element 5 during its production. Since, because of the lack of adhesion of the embedding mass 7 to the preserving element, the danger would exist that it might fall out of the preserving troughs 6 together with the preserved connecting bars 3, flat safety strips 8, made for example of polystyrene, extending across the preserving troughs 6, resting in the region thereof against the embedding mass 7, are detachably fastened to the wall of the element 5 forming the flat side 5*a*, e.g., by spot welding, adhesive connection, or by means of rivets, bolts, or the like.

In a variant of execution which is illustrated in FIG. 4, the preserving troughs 6 might have a cross-section narrowing toward the flat side, e.g., trapezoidal, so that the embedding mass 7 is form-lockingly held in them. With such a design, safety strips 8 may be dispensed with.

Adhesion of the embedding mass 7 to the structural member 2 can be avoided by a coating of the free surface of this mass with a parting compound, as for example white lime.

The side of the safety strips 8 facing away from the embedding mass 7 may have a profiling, e.g., a grooving, in order that the surface portions of the structural member 2 formed thereon receive a corresponding profiling, which contributes to the roughening of the construction joint obtained thereafter.

For the same purpose, this side and/or the free surface of the embedding mass can be provided with a coating consisting of a cement setting retarder; the incompletely set surface layer portions on the structure 2 can then be sprayed off with water after removal of the device.

After removal of the shuttering 1 and the preserving element 5, the brittle embedding mass 7 is to be removed, which can take place by administering some few hammer blows on the end sections 3*b* of the connecting bars 3. Before or after the bending-out of these end sections 3*a* into the rectilineal continuation of the legs of the anchored section 3*a*, the possibly used safety strips 8 are also still to be taken away.

The device finds wide use in the production of construction joints in steel concrete structures of any kind, e.g., in the connection of partitions, steps, light-shafts, false floors, silo covers, etc., e.g., to a main wall.

I claim:

1. A reinforcement device adapted to be attached to a casing on which a steel-reinforced concrete structural member is to be made, said device comprising an elongate holding element made substantially of a thin-walled plastic mold, and reinforcing bars, the end portions of which, bent-off approximately at right angles, are in said element, said elongate holding element defining troughs open toward one side of the element and receiving said end portions therein and cast in an embedding material which is brittle in its solidified state, but does not adhere either to said reinforcing bars or to said element, said device being as a whole a rigid structural unit of permanent shape.

2. A reinforcement device according to claim 1, wherein said bent-off portions have convex sides, and said one side of the elongated holding element is provided with elevations against which said convex sides of the bent-off portions of said reinforcing bars abut.

3. A reinforcement device according to claim 1, wherein the cross-sectional form of said troughs is convergent towards the open side thereof.

4. A reinforcement device according to claim 1, including flat safety strips on said one side extending transversely across the troughs and resting on the solidified embedding material filling the troughs, said safety strips being detachably connected to said one side of the element.

5. A reinforcement device according to claim 4, wherein each said safety strip has a side facing away from the embedding material and said side is profiled.

6. A reinforcement device according to claim 4, wherein said side of each safety strip facing away from the embedding material, and/or the free surface of the embedding material, is provided with a coating of concrete loosening retarder.

7. A reinforcement device adapted to be attached to a structure on which a metal reinforced concrete structural member is to be made, said device comprising an elongate holding element including a thin-walled plastic mold device and metal reinforcing bars, the end portions of said reinforcing bars extending approximately at right angles to a center portion of the reinforcing bars, said elongate holding element defining a pair of longitudinally extending troughs open toward one side of the element and receiving said end portions therein, said end portions being embedded in a brittle material that does not adhere either to said reinforcing bars or to said mold device, said reinforcement device being a rigid structural unit.

* * * * *